US008505556B2

(12) United States Patent
Park et al.

(10) Patent No.: US 8,505,556 B2
(45) Date of Patent: Aug. 13, 2013

(54) TAPPING APPLICATOR

(75) Inventors: Wooram Park, Yongin-si (KR); Cheonghwan Hwang, Seoul (KR); Jungsun Choi, Seongnam-si (KR); Yoonkyun Hwang, Ulsan (KR); Jinwoong Kim, Yongin-si (KR)

(73) Assignee: Amorepacific Corporation, Seoul (KR)

( * ) Notice: Subject to any disclaimer, the term of this patent is extended or adjusted under 35 U.S.C. 154(b) by 0 days.

(21) Appl. No.: 13/576,257

(22) PCT Filed: Jan. 24, 2011

(86) PCT No.: PCT/KR2011/000461

§ 371 (c)(1),
(2), (4) Date: Jul. 31, 2012

(87) PCT Pub. No.: WO2011/096660

PCT Pub. Date: Aug. 11, 2011

(65) Prior Publication Data

US 2012/0291798 A1 Nov. 22, 2012

(30) Foreign Application Priority Data

Feb. 5, 2010 (KR) ..... 20-2010-0001311 U

(51) Int. Cl.
*A45D 40/26* (2006.01)

(52) U.S. Cl.
USPC ..... 132/320

(58) Field of Classification Search
USPC ..... 132/320, 75.8, 73.5, 73.6, 293, 218; 15/208; 401/195
See application file for complete search history.

(56) References Cited

U.S. PATENT DOCUMENTS

2010/0111590 A1* 5/2010 Pires et al. ..... 401/195

FOREIGN PATENT DOCUMENTS

KR 20-0234890 Y1 10/2001
KR 10-2002-0043266 A 6/2002
KR 10-0378989 B1 4/2003
KR 20-0399929 Y1 11/2005

OTHER PUBLICATIONS

International Search Report of PCT/KR2011/000461.

* cited by examiner

*Primary Examiner* — Robyn Doan
(74) *Attorney, Agent, or Firm* — Maxon IP LLC; Justin H. Kim

(57) ABSTRACT

A tapping applicator comprises a stationary part, a vibrating part, a vibrating plate, a puff, a power supply, and a control part. The stationary part consists of a casing, an insulating spool provided on the bottom of the casing, and a coil which winds around the insulating spool. The vibrating part consists of a magnet inserted to move up and down along a hollow of the insulating spool. The vibrating plate is integrated into the magnet in the top of the magnet. The puff is vibrated by vibrations of the vibrating plate. The power supply supplies an alternating current power source to the coil. The control part controls the vibration-generating module.

6 Claims, 10 Drawing Sheets

TAPPING APPLICATOR

TECHNICAL FIELD

The present invention relates to a tapping applicator which is used for the application of cosmetics. More specifically, the present invention relates to a tapping applicator in which a puff is vibrated up and down by moving a permanent magnet vertically using an alternating current.

BACKGROUND OF THE INVENTION

A puff is generally used as means for spreading evenly and smoothly color cosmetics such as foundation, skin cover or powder applied on user's face. When using the puff, a user first inserts his/her fingers into a finger-inserting band formed on one side of the puff, and taps the other side of the puff against user's face where cosmetics are applied to spread cosmetics.

However, tapping the puff against user's face using an artificial force through the inserted fingers as described above is bothersome, and a user who is unfamiliar to makeup may not have a constant tapping force, and thus the makeup may become cakey.

Meanwhile, drive-puff technologies for tapping a puff automatically have been developed. However, in such technologies, since a puff is vibrated in irregular directions not is vibrated up and down, there is a problem that cosmetics does not permeate well into user's face. Further, since the number of vibrations varies depending on positions of a drive-puff, there is a problem that cosmetics only partly permeate into user's face, and the overall brightness of face becomes uneven.

SUMMARY

Object of the Invention

The present invention has been invented to solve the aforementioned problems.

According to the present invention, it is provided a tapping applicator in which a puff is vibrated up and down not horizontally.

Furthermore, according to the present invention, it is provided a tapping applicator in which the number of vibrations of a puff is predetermined at a desired value and the predetermined value is maintained uniformly, so that the overall brightness of face after makeup becomes uniform.

Means to Achieve the Object

According to the present invention, it is provided a tapping applicator which is characterized by comprising: a stationary part consisting of a casing, an insulating spool provided on the bottom of the casing, and a coil which winds around the insulating spool; a vibrating part consisting of a magnet inserted to move up and down along a hollow of the insulating spool, a vibrating plate integrated into the magnet in the top of the magnet, and a puff which is vibrated by vibrations of the vibrating plate; a power supply which supplies an alternating current power source to the coil; and a control part which controls the vibration-generating module.

Herein, the power supply may consist of a battery, and a vibration-generating module which converts direct currents from the battery to alternating currents.

Furthermore, the power supply may consist of a home power source between 100V and 200V, and a transforming module which drops a voltage from the home power source.

The puff may be NBR puff or flocking puff. More preferably, the NBR puff has compressibility between 20% and 40%, and the flocking puff has a filament length between 0.6 mm and 1.4 mm.

Effect of the Invention

The tapping applicator according to the present invention converts electric energy by alternating currents to kinetic energy using the principle of an electric motor, and the kinetic energy vibrates a magnet and a puff connected to the magnet up and down (longitudinally). Thus, the tapping applicator of the present invention has the effect that cosmetics permeate well into user's face by the puff vibrating up and down.

Furthermore, the tapping applicator according to the present invention can optionally adjust frequency using a vibration-generating module. The frequency can be predetermined at a desired value, and the puff can be vibrated uniformly along the predetermined frequency. Thus, the tapping applicator of the present invention has the effect that cosmetics spread evenly on user's face and the overall brightness of face becomes uniform.

In addition, the tapping applicator according to the present invention can effectively tap cosmetics, thereby improving the adhesion between cosmetics and skin and maintaining long makeup. Moreover, since the tapping applicator according to the present invention taps cosmetics against user's face, the circulation of blood is facilitated by a massage effect, thereby enabling more bright and colorful makeup.

PREFERRED EMBODIMENTS TO IMPLEMENT THE INVENTION

Hereinafter, a tapping applicator according to the present invention will be described with reference to Examples and the accompanying drawings.

EXAMPLE 1

Figure 1:
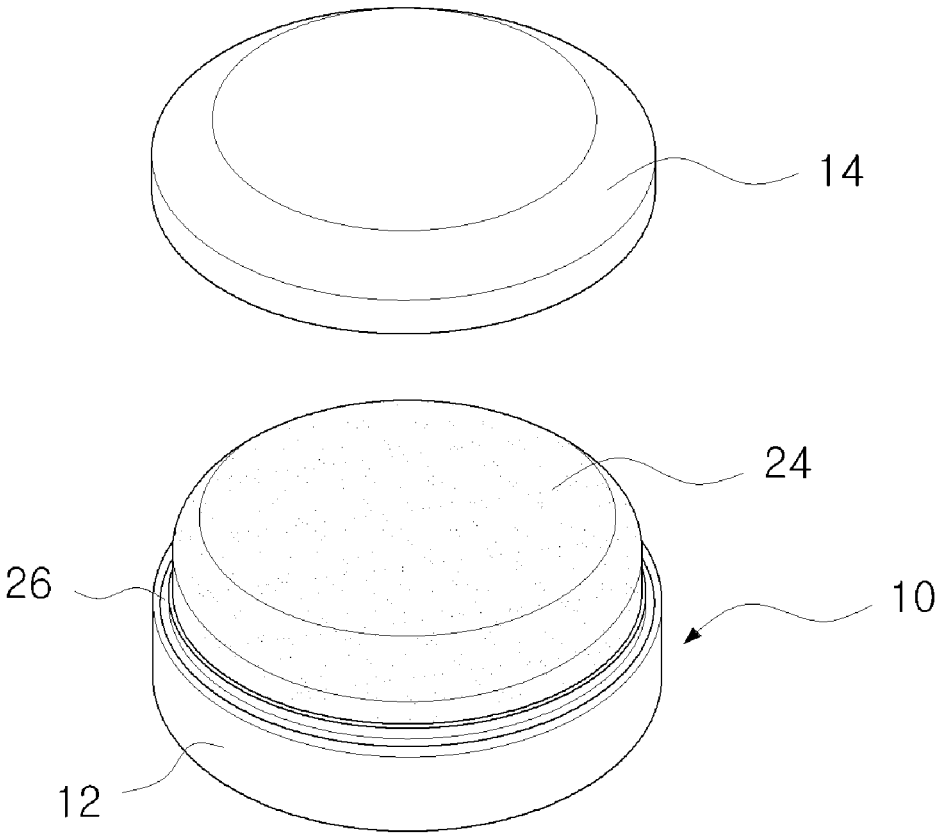
FIG. 1 shows an exterior perspective view of a tapping applicator with accordance to Example 1 of the present invention.
Figure 2:
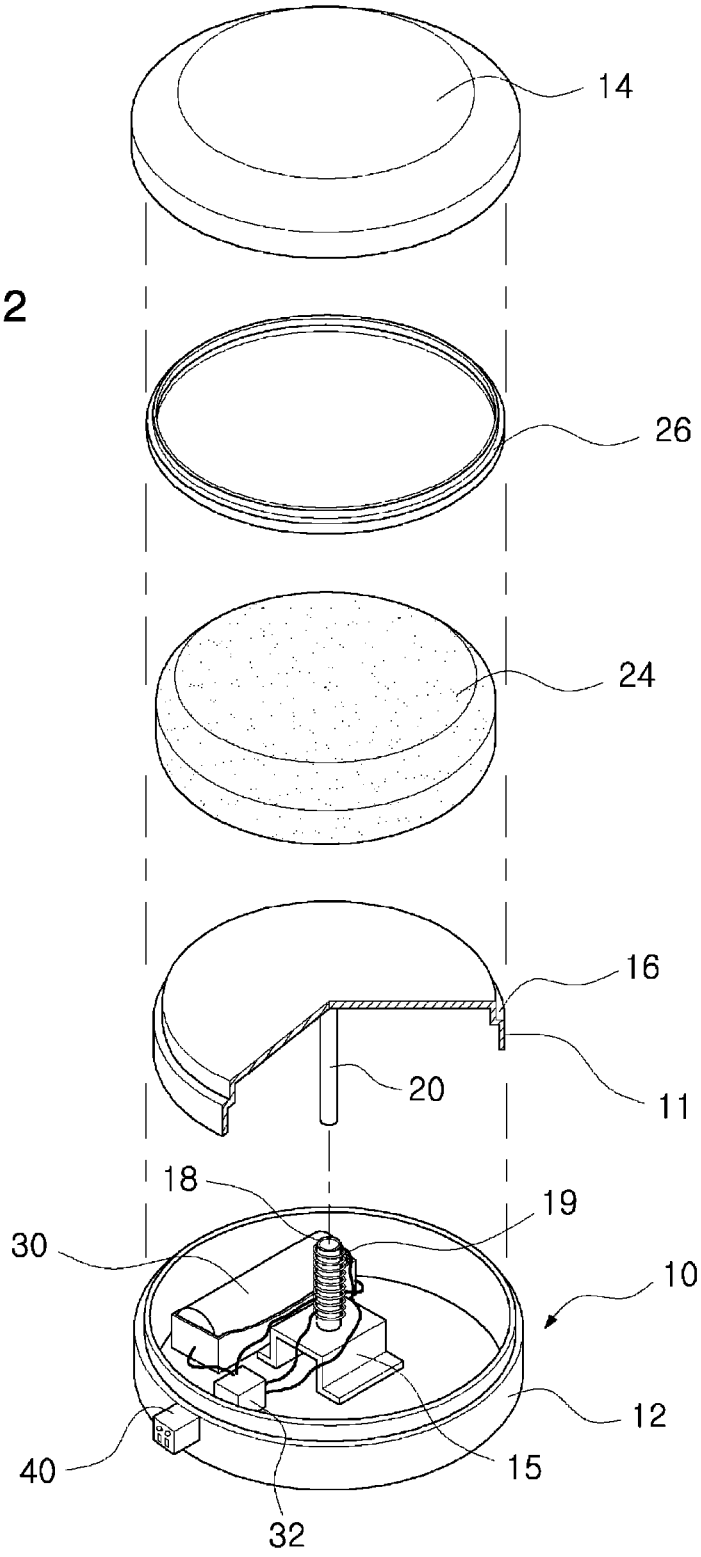
FIG. 2 shows an exploded perspective view of a tapping applicator with accordance to Example 1 of the present invention.
Figure 3:
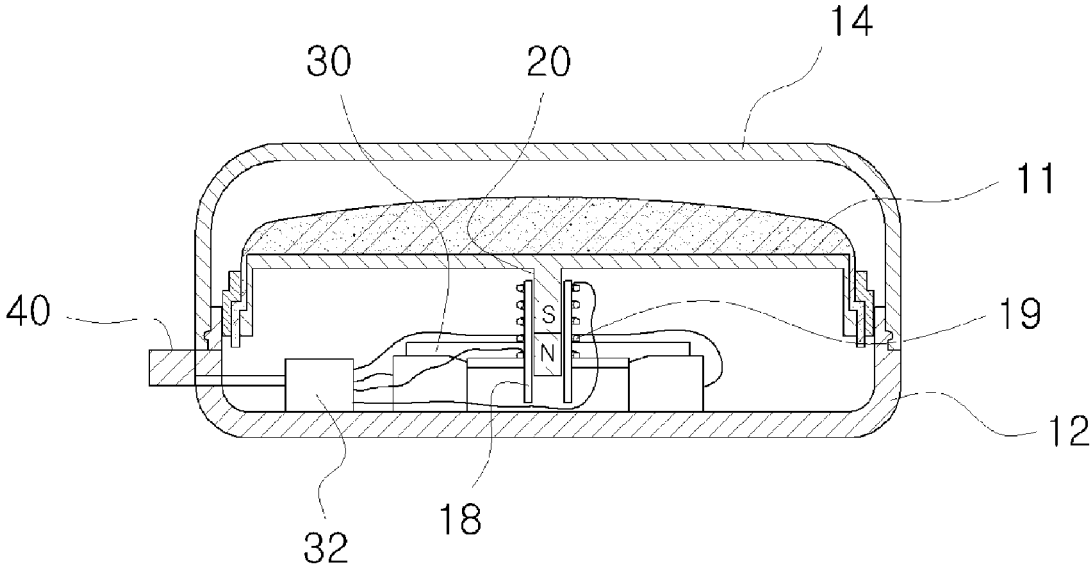
FIG. 3 shows a cross-sectional view of a tapping applicator with accordance to Example 1 of the present invention with a magnet dropped.
Figure 4:
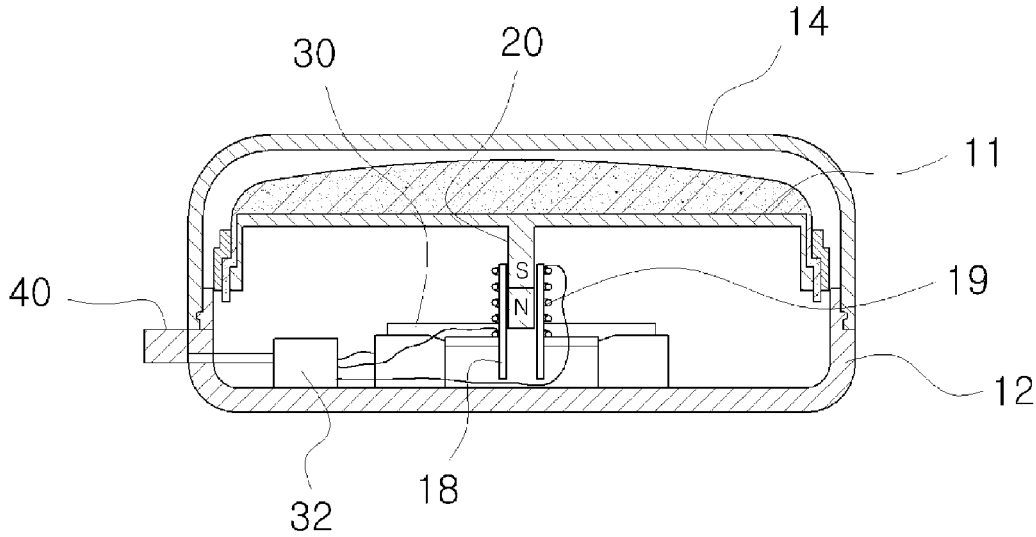
FIG. 4 shows a cross-sectional view of a tapping applicator with accordance to Example 1 of the present invention with a magnet elevated.

FIG. 1 shows an exterior perspective view of a tapping applicator with accordance to Example 1 of the present invention; FIG. 2 shows an exploded perspective view of a tapping applicator with accordance to Example 1 of the present invention; FIG. 3 shows a cross-sectional view of a tapping applicator with accordance to Example 1 of the present invention with a magnet dropped; and FIG. 4 shows a cross-sectional view of a tapping applicator with accordance to Example 1 of the present invention with a magnet elevated.

According to Example 1 of the present invention, a tapping applicator comprises a stationary part; a vibrating part vibrating provided on the stationary part; a power supply which supplies a power source; and a control part which controls the power supply.

The stationary part consists of casing 10, insulating spool 18 provided on the bottom of casing 10, and coil 19 which winds around insulating spool 18.

Casing 10 consists of upper case 14 and lower case 12 which is removably provided on upper case 14, and an interior space is formed by upper case 14 and lower case 12.

Insulating spool 18 is provided on the bottom of lower case 12, and has a cylindrical shape with the top and bottom portions opened. Preferably, insulating spool 18 is fitted on support 15 which projects upwardly such that magnet 20 drops a desired path toward the bottom of the insulating spool. Furthermore, insulating spool 18 is preferably formed of engineering plastics in the terms of an insulating property and strength.

Coil 19 which winds around insulating spool 18 applies an alternating current power source, thereby forming electric field to move up and down magnet 20, as described below.

The vibrating part consists of magnet 20 inserted into the interior of insulating spool 18 which is movable up and down, vibrating plate 11 integrated in the top of magnet 20, and puff 24 which be vibrated by vibrations of vibrating plate 11.

Magnet 20 has a rod shape in which positive and negative poles (or negative and positive poles) are formed on the upper and lower portions of the rod, respectively, so that the magnet moves upwardly and downwardly depending on the directions of currents applied in coil 19. The movement direction of magnet 20 is determined depending on the directions of currents which flow on coil 19 according to Fleming's left hand rule.

Vibrating plate 11 is provided on the top of the magnet and has a disc shape which can be covered by puff 24. Thus, as magnet 20 vibrates up and down, vibrating plate 11 is engaged and vibrated up and down. Puff 24 is fitted to vibrate by vibrations of vibrating plate 11.

Puff 24 is inserted and fixed into step height portion 16 formed on a rim of vibrating plate 11 by ring 26 such that puff 24 is fitted to cover vibrating plate 11 formed on the top of magnet 20. Thus, since vibrating plate 11 is covered by puff 24, puff 24 is vibrated by vibrations of vibrating plate 11. Preferably, puff 24 may be NBR puff or flocking puff. When using the NBR puff, puff 24 has a good feeling of adhesion to skin, and enables natural makeup which blends well with skin. When using the flocking puff, puff 24 has a good feeling of use, and is suitable for bright and colorful makeup. Preferably, the NBR puff has compressibility between 20% and 40% to transmit effectively vibrations, and the flocking puff has a filament length between 0.6 mm and 1.4 mm to obtain both of a good feeling of use and vibration effect. Cosmetics which may be applied by puff 24 include loose powders, pressed powders, liquid foundations, makeup bases, primer formulations, cake type base makeup and point makeup.

The power supply is provided to supply an alternating current power source to coil 19. The power supply consists of battery 30, and vibration-generating module 32 which converts the power source from battery 30 to alternating currents.

Battery 30 is provided to supply a direct current power source, and may use a primary battery or a secondary battery.

Vibration-generating module 32 converts direct currents to alternating currents, and can preferably alter frequency.

Control part 40 is provided to control vibration-generating module 32, and can alter the number of vibrations of magnet 20 by controlling frequency of vibration-generating module 32.

EXAMPLE 2

Figure 5:
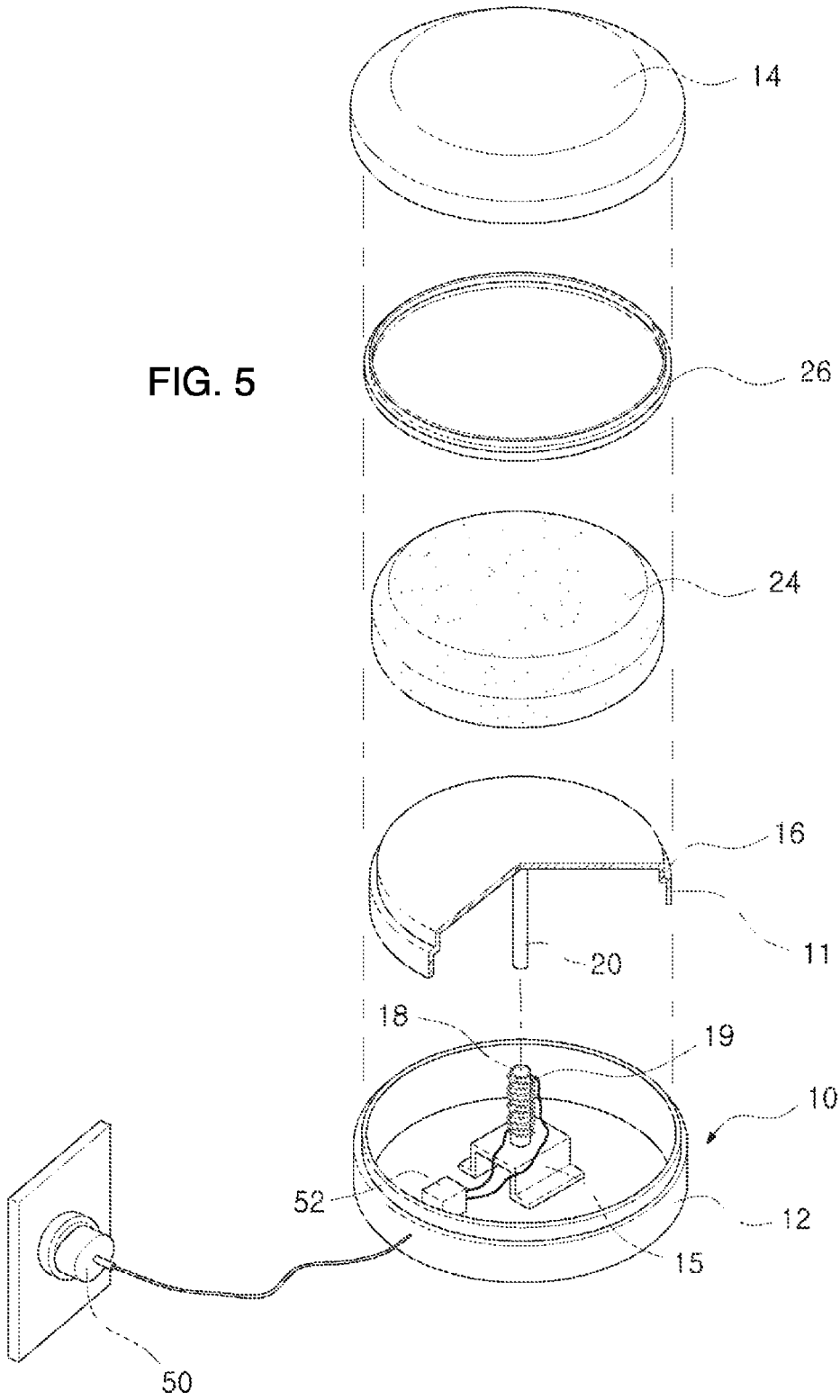
FIG. 5 shows an exploded perspective view of a tapping applicator with accordance to Example 2 of the present invention.
Figure 6:
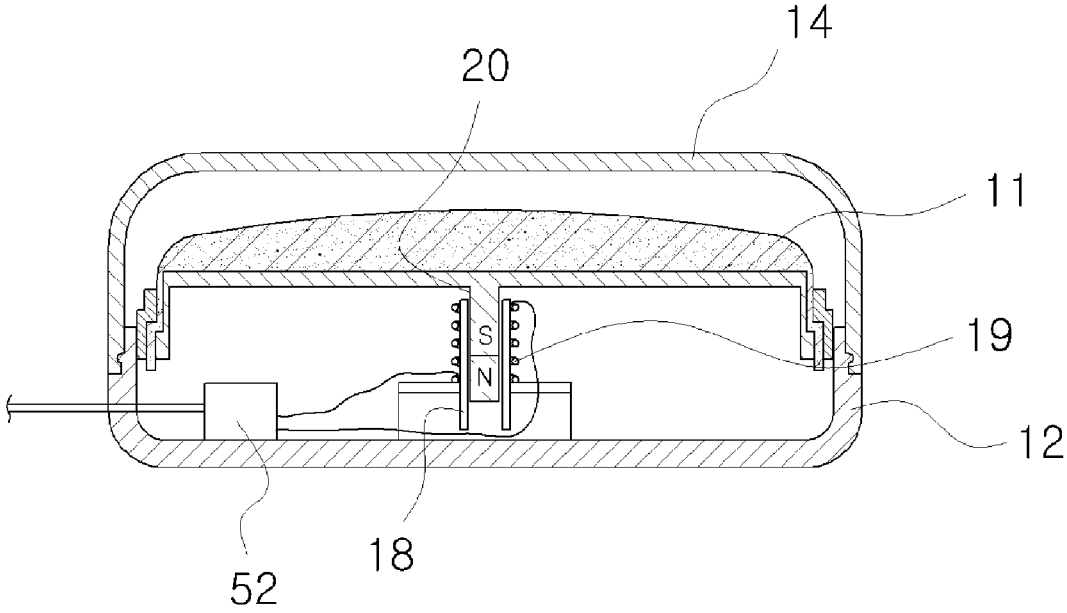
FIG. 6 shows a cross-sectional view of a tapping applicator with accordance to Example 2 of the present invention with a magnet dropped.
Figure 7:
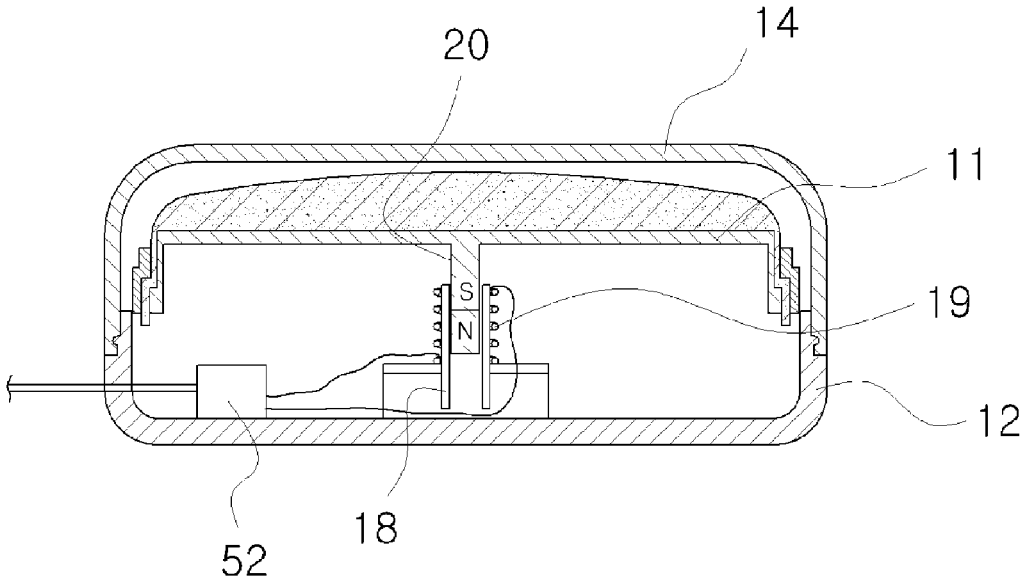
FIG. 7 shows a cross-sectional view of a tapping applicator with accordance to Example 2 of the present invention with a magnet elevated.

FIG. 5 shows an exploded perspective view of a tapping applicator with accordance to Example 2 of the present invention; FIG. 6 shows a cross-sectional view of a tapping applicator with accordance to Example 2 of the present invention with a magnet dropped; and FIG. 7 shows a cross-sectional view of a tapping applicator with accordance to Example 2 of the present invention with a magnet elevated.

According to Example 2 of the present invention, a tapping applicator comprises a stationary part; a vibrating part vibrating provided on the stationary part; and a power supply which supplies a power source.

The stationary part consists of casing 10, insulating spool 18 provided on the bottom of casing 10, and coil 19 which winds around insulating spool 18.

Casing 10 consists of upper case 14 and lower case 12 which is removably provided on upper case 14, and an interior space is formed by upper case 14 and lower case 12.

Insulating spool 18 is provided on the bottom of lower case 12, and has a cylindrical shape with the top and bottom portions opened. Preferably, insulating spool 18 is fitted on support 15 which projects upwardly such that magnet 20 drops a desired path toward the bottom of the insulating spool. Furthermore, insulating spool 18 is preferably formed of engineering plastics in the terms of an insulating property and strength.

Coil 19 which winds around insulating spool 18 applies an alternating current power source, thereby forming electric field to move up and down magnet 20, as described below.

The vibrating part consists of magnet 20 inserted into the interior of insulating spool 18 which is movable up and down, vibrating plate 22 integrated in the top of magnet 20, and puff 24 which be vibrated by vibrations of vibrating plate 22.

Magnet 20 has a rod shape in which positive and negative poles (or negative and positive poles) are formed on the upper and lower portions of the rod, respectively, so that the magnet moves upwardly and downwardly depending on the directions of currents applied in coil 19. The movement direction of magnet 20 is determined depending on the directions of currents which flow on coil 19 according to Fleming's left hand rule.

Vibrating plate 11 is provided on the top of the magnet and has a disc shape which can be covered by puff 24. Thus, as magnet 20 vibrates up and down, vibrating plate 11 is engaged and vibrated up and down. Puff 24 is fitted to vibrate by vibrations of vibrating plate 11, and preferably puff 24 may be NBR puff or flocking puff. Puff 24 is inserted and fixed into step height portion 16 formed on a rim of vibrating plate 11 by ring 26 such that [0054] puff 24 is fitted to cover vibrating plate 11 formed on the top of magnet 20. Thus, since vibrating plate 11 is covered by puff 24, puff 24 is vibrated by vibrations of vibrating plate 11. When using the NBR puff, puff 24 has a good feeling of adhesion to skin, and enables natural makeup which blends well with skin. When using the flocking puff, puff 24 has a good feeling of use, and is suitable for bright and colorful makeup. Preferably, NBR puff has compressibility between 20% and 40% to transmit effectively vibrations, and the flocking puff has a filament length between 0.6 mm and 1.4 mm to obtain both of a good feeling of use and vibration effect. Cosmetics which may be applied by puff 24 include loose powders, pressed powders, liquid foundations, makeup bases, primer formulations, cake type base makeup and point makeup.

The power supply is provided to supply an alternating current power source to coil 19, and consists of home power source 50 and transforming module 52 which drops a voltage of home power source 50.

Home power source 50 is an alternating current power source, and supplies a voltage between 100V and 200V. Home power source 50 is preferably a single phase power source such that the power source is easily applied.

Transforming module 52 drops a voltage applied from home power source 50 to lower voltage, preferably below 15V which is necessary for fine operation.

EXAMPLE 3

Figure 8:
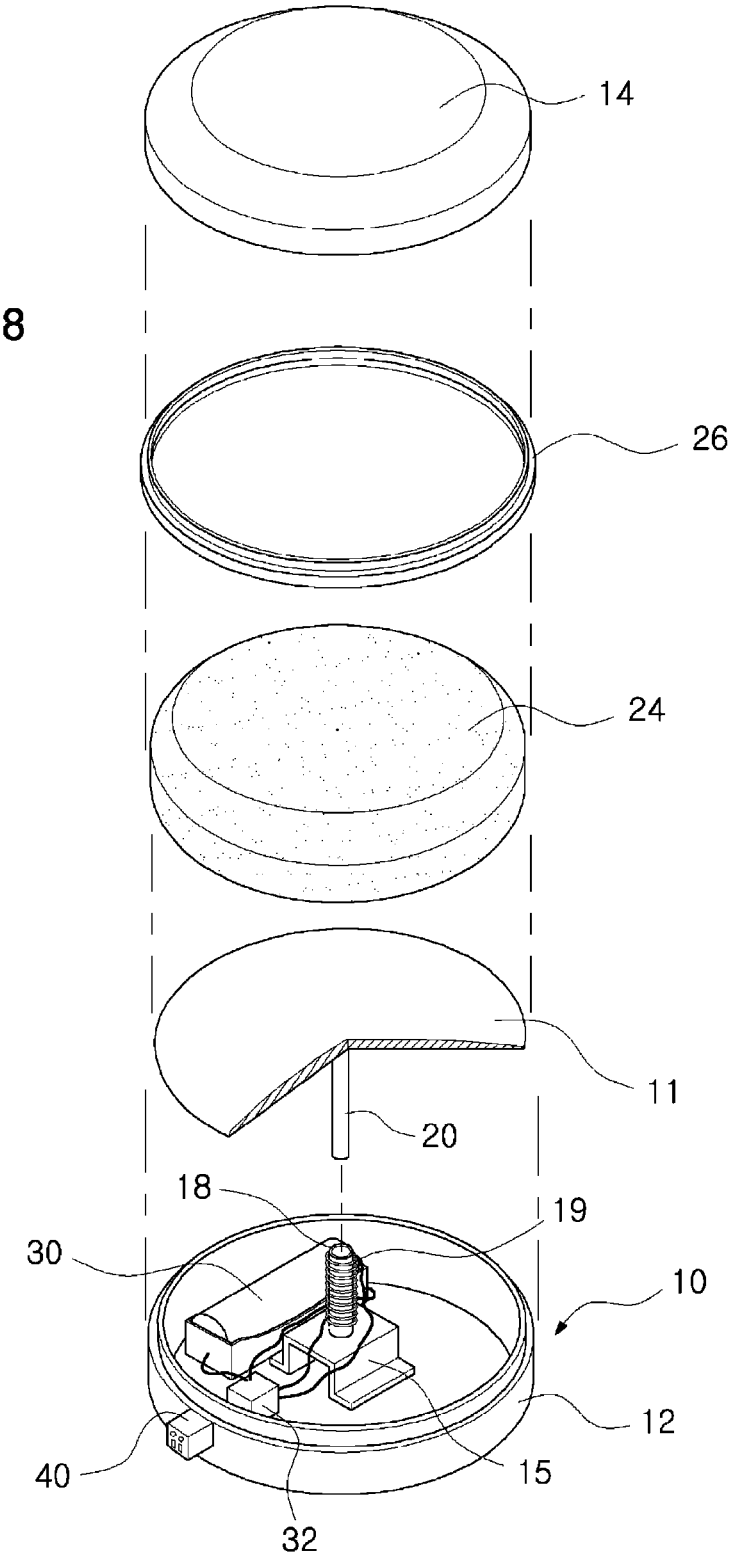
FIG. 8 shows an exploded perspective view of a tapping applicator with accordance to Example 3 of the present invention.
Figure 9:
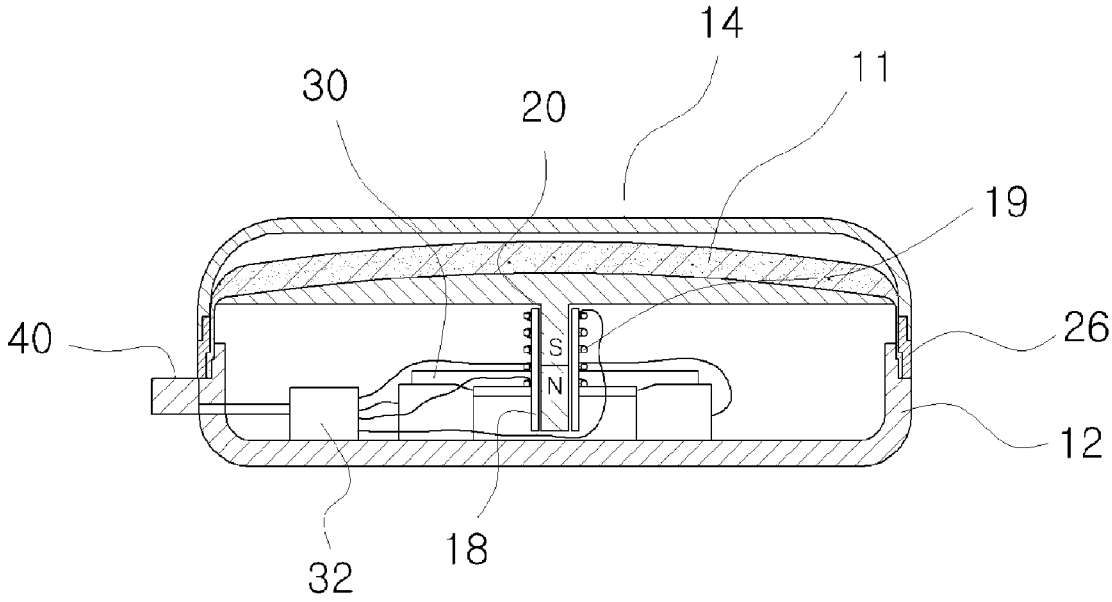
FIG. 9 shows a cross-sectional view of a tapping applicator with accordance to Example 3 of the present invention with a magnet dropped.
Figure 10:
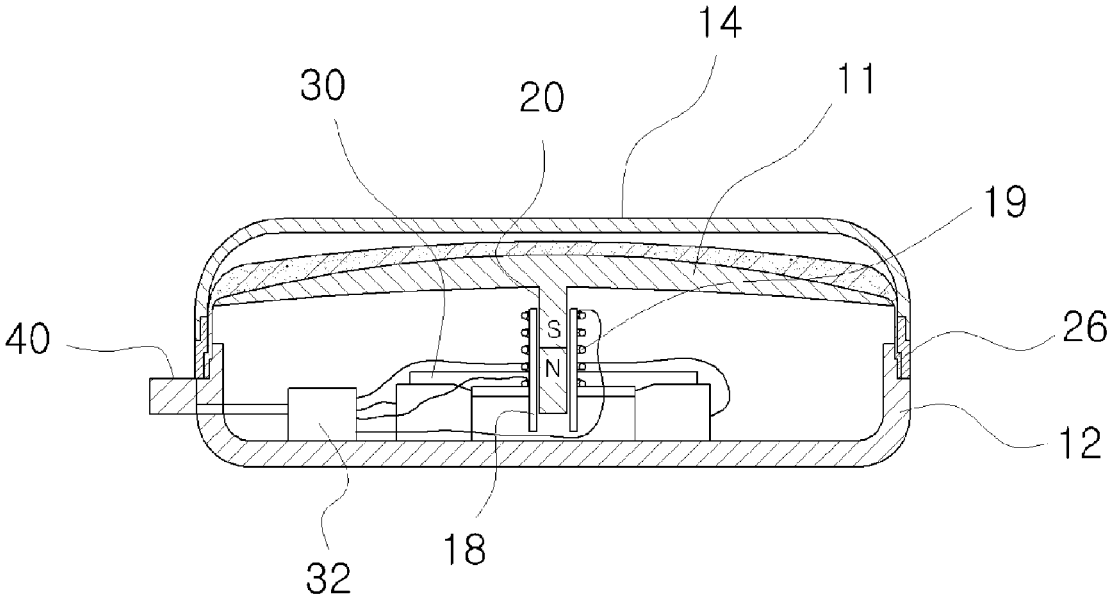
FIG. 10 shows a cross-sectional view of a tapping applicator with accordance to Example 3 of the present invention with a magnet elevated.

FIG. 8 shows an exploded perspective view of a tapping applicator with accordance to Example 3 of the present invention; FIG. 9 shows a cross-sectional view of a tapping applicator with accordance to Example 3 of the present invention with a magnet dropped; and FIG. 10 shows a cross-sectional view of a tapping applicator with accordance to Example 3 of the present invention with a magnet elevated.

According to Example 3 of the present invention, a tapping applicator comprises a stationary part; a vibrating part vibrating provided on the stationary part; a power supply which supplies a power source; and a control part which controls the power supply.

The stationary part consists of casing 10, insulating spool 18 provided on the bottom of casing 10, and coil 19 which winds around insulating spool 18.

Casing 10 consists of upper case 14 and lower case 12 which is removably provided on upper case 14, and an interior space is formed by upper case 14 and lower case 12. In addition, ring 26 is provided on the peripheral portion of lower case 12 to fix puff 24.

Insulating spool 18 is provided on the bottom of lower case 12, and has a cylindrical shape with the top and bottom portions opened. Preferably, insulating spool 18 is fitted on support 15 which projects upwardly such that magnet 20 drops a desired path toward the bottom of the insulating spool. Furthermore, insulating spool 18 is preferably formed of engineering plastics in the terms of an insulating property and strength.

Coil 19 which winds around insulating spool 18 applies an alternating current power source, thereby forming electric field to move up and down magnet 20, as described below.

The vibrating part consists of magnet 20 inserted into the interior of insulating spool 18 which is movable up and down, vibrating plate 22 integrated in the top of magnet 20, and puff 24 which be vibrated by vibrations of vibrating plate 22.

Magnet 20 has a rod shape in which positive and negative poles (or negative and positive poles) are formed on the upper and lower portions of the rod, respectively, so that the magnet moves upwardly and downwardly depending on the directions of currents applied in coil 19. The movement direction of magnet 20 is determined depending on the directions of currents which flow on coil 19 according to Fleming's left hand rule.

Vibrating plate 11 is provided on the top of the magnet and has a disc shape which can be covered by puff 24. Thus, as magnet 20 vibrates up and down, vibrating plate 11 is engaged and vibrated up and down.

Puff 24 is fitted to vibrate by vibrations of vibrating plate 11, and preferably may be NBR puff or flocking puff. Puff 24 is fitted into lower case 12 by annular ring 26 such that puff 24 cover vibrating plate 11 formed on the top of magnet 24. Thus, since vibrating plate 11 is covered by puff 24, and puff 24 is generally formed of elastic material, puff 24 is vibrated by vibrations of vibrating plate 11. Preferably, puff 24 may be NBR puff or flocking puff. When using the NBR puff, puff 24 has a good feeling of adhesion to skin, and enables natural makeup which blends well with skin. When using the flocking puff, puff 24 has a good feeling of use, and is suitable for bright and colorful makeup. Preferably, NBR puff has compressibility between 20% and 40% to transmit effectively vibrations, and the flocking puff has a filament length between 0.6 mm and 1.4 mm to obtain both of a good feeling of use and vibration effect. Cosmetics which may be applied by puff 24 include loose powders, pressed powders, liquid foundations, makeup bases, primer formulations, cake type base makeup and point makeup.

The power supply is provided to supply an alternating current power source to coil 19. The power supply consists of battery 30, and vibration-generating module 32 which converts the power source from battery 30 to alternating currents.

Battery 30 is provided to supply a direct current power source, and may use a primary battery or a secondary battery.

Vibration-generating module 32 converts direct currents to alternating currents, and can preferably alter frequency.

Control part 40 is provided to control vibration-generating module 32, and can alter the number of vibrations of magnet 20 by controlling frequency of vibration-generating module 32.

| [Description of Reference Numbers] | |
|---|---|
| 10: Casing | 11: Vibrating Plate |
| 12: Lower Case | 14: Upper Case |
| 18: Spool | 19: Coil |
| 20: Magnet | 24: Puff |
| 30: Battery | 32: Vibration-generating Module |
| 40: Control Part | 50: Home Power Source |
| 52: Transforming Module | |

The invention claimed is:

1. A tapping applicator comprising:

a stationary part consisting of a casing, an insulating spool provided on the bottom of the casing, and a coil which winds around the insulating spool;

a vibrating part consisting of a magnet inserted to move up and down along a hollow of the insulating spool, a vibrating plate integrated into the magnet in the top of the magnet, and a puff which is vibrated by vibrations of the vibrating plate; and a power supply which supplies an alternating current power source to the coil.

2. The tapping applicator according to claim 1, wherein the power supply consists of a battery, a vibration-generating module which converts direct currents from the battery to alternating current, and a control part which controls the vibration-generating module.

3. The tapping applicator according to claim 1, wherein the power supply consists of a home power source between 100V and 200V, and a transforming module which drops a voltage from the home power source.

4. The tapping applicator according to claim 1, wherein the puff is NBR puff or flocking puff.

5. The tapping applicator according to claim 4, wherein the NBR puff has compressibility between 20% and 40%.

6. The tapping applicator according to claim 1, wherein the flocking puff has a filament length between 0.6 mm and 1.4 mm.

* * * * *